US010886082B1

(12) United States Patent
Wang et al.

(10) Patent No.: US 10,886,082 B1
(45) Date of Patent: Jan. 5, 2021

(54) LIGHT CONTROL DIAPHRAGM FOR AN ELECTRONIC DEVICE

(71) Applicant: Apple Inc., Cupertino, CA (US)

(72) Inventors: Paul X. Wang, Cupertino, CA (US); Simon R. Lancaster-Larocque, San Jose, CA (US); Chia Chi Wu, Taipei (TW)

(73) Assignee: APPLE INC., Cupertino, CA (US)

( * ) Notice: Subject to any disclaimer, the term of this patent is extended or adjusted under 35 U.S.C. 154(b) by 105 days.

(21) Appl. No.: 15/946,695

(22) Filed: Apr. 5, 2018

Related U.S. Application Data

(60) Provisional application No. 62/557,717, filed on Sep. 12, 2017.

(51) Int. Cl.
*H01H 13/83* (2006.01)
*H01H 13/02* (2006.01)

(52) U.S. Cl.
CPC ..... *H01H 13/83* (2013.01); *H01H 13/023* (2013.01); *H01H 2215/006* (2013.01); *H01H 2219/036* (2013.01); *H01H 2219/054* (2013.01)

(58) Field of Classification Search
CPC ..... H01H 13/83; H01H 2215/006
USPC ..... 200/314
See application file for complete search history.

(56) References Cited

U.S. PATENT DOCUMENTS

| | | | | |
|---|---|---|---|---|
| 5,695,859 | A | 12/1997 | Burgess | |
| 7,935,904 | B2 * | 5/2011 | Song | G06F 1/1624 200/310 |
| 8,884,174 | B2 | 11/2014 | Chou | |
| 9,557,857 | B2 | 1/2017 | Shediwy | |
| 9,704,670 | B2 | 7/2017 | Leong et al. | |
| 2009/0267892 | A1 | 10/2009 | Faubert | |
| 2012/0092263 | A1 | 4/2012 | Peterson et al. | |
| 2013/0044049 | A1 | 2/2013 | Biggs et al. | |
| 2013/0120265 | A1 | 3/2013 | Horli et al. | |
| 2014/0203953 | A1 | 7/2014 | Moser et al. | |
| 2014/0218303 | A1 | 8/2014 | Kao et al. | |
| 2015/0090571 | A1 * | 4/2015 | Leong | H01H 13/83 200/5 A |
| 2016/0049265 | A1 | 2/2016 | Bernstein | |
| 2016/0189892 | A1 * | 6/2016 | Liu | H01H 13/83 362/23.03 |

(Continued)

FOREIGN PATENT DOCUMENTS

| | | |
|---|---|---|
| WO | WO2008/125130 | 10/2008 |

*Primary Examiner* — Nguyen Tran
*Assistant Examiner* — Iman Malakooti
(74) *Attorney, Agent, or Firm* — Dorsey & Whitney LLP

(57) ABSTRACT

Embodiments are directed to a keyboard or other input structure having a diaphragm that controls the illumination of a perimeter of a keycap. In one aspect, the keyboard includes a dome configured to buckle in response to a depression of a keycap. A support structure may support the keycap above the dome. A light source may be positioned below the keycap and configured to illuminate one or more illuminable symbols defined on a top surface. A diaphragm may be positioned above the light source and have a barrier portion extending from a perimeter of the keycap. The barrier portion may be configured to control illumination of the perimeter of the light source, including substantially preventing the illumination of the perimeter in order to mask or conceal an illuminated halo around the keycap.

18 Claims, 10 Drawing Sheets

(56) References Cited

U.S. PATENT DOCUMENTS

2016/0351360 A1* 12/2016 Knopf ..... H01H 13/70
2018/0081437 A1 3/2018 Taylor et al.

* cited by examiner

LIGHT CONTROL DIAPHRAGM FOR AN ELECTRONIC DEVICE

CROSS-REFERENCE TO RELATED APPLICATION(S)

This application is a nonprovisional patent application of and claims the benefit of U.S. Provisional Patent Application No. 62/557,717, filed Sep. 12, 2017 and titled "Light Control Diaphragm for an Electronic Device," the disclosure of which is hereby incorporated herein by reference in its entirety.

FIELD

The described embodiments relate generally to input devices for computing systems. More particularly, the present embodiments relate to structures that facilitate illumination of a keyboard.

BACKGROUND

In computing systems, a keyboard may be employed to receive input from a user. Many traditional keyboards may suffer from significant drawbacks that may affect the visibility of keyboard keys in a dimly-lit environment. In many cases, keyboards include components that illuminate keyboard keys in an undesirable manner. Further, keyboards may be susceptible to debris or other contaminants in an external environment.

SUMMARY

Embodiments of the present invention are directed to a keyboard assembly.

In a first aspect, the present disclosure includes an electronic device. The electronic device includes a key web having an array of openings. The electronic device further includes a keycap at least partially positioned within an opening or the array of opening and separated from the key web by a gap extending between a perimeter of the keycap and adjacent segments of the key web. The electronic device further includes a support structure pivotally coupled with an underside of the keycap. The electronic device further includes a substrate positioned below the support structure. The electronic device further includes a diaphragm connected to the underside of the keycap and covering a portion of the substrate beneath the gap. The electronic device further includes a light source positioned below the diaphragm. The diaphragm may be configured to control propagation of light through the gap.

In a second aspect, the present disclosure includes an input structure. The input structure includes a keycap having an illuminable symbol. The input structure further includes a diaphragm positioned below the keycap and having an opaque layer positioned on a translucent layer. At least a portion of the diaphragm may extend away from a perimeter of the keycap. The input structure further includes a support structure positioned below the keycap and configured to guide downward movement of the keycap in response to a key press. The support structure further includes a light source positioned under the diaphragm and configured to illuminate the illuminable symbol. The opaque layer may be configured to substantially prevent light from the light source from illuminating the perimeter of the keycap. The diaphragm may be configured to deform when the keycap moves.

In a third aspect, the present disclosure includes a keyboard. The keyboard includes a key web defining an opening. The keyboard further includes a keycap positioned in the opening. The keyboard further includes a dome configured to buckle in response to a depression of the keycap. The keyboard further includes a support structure positioned about the dome and supporting the keycap. The keyboard further includes a light source positioned below the keycap. The keyboard further includes a diaphragm positioned above the light source and having a barrier portion extending outwardly from a peripheral portion of the keycap, the barrier portion configured to control illumination of a gap defined between the keycap and the opening in the key web.

In addition to the exemplary aspects and embodiments described above, further aspects and embodiments will become apparent by reference to the drawings and by study of the following description.

BRIEF DESCRIPTION OF THE DRAWINGS

The disclosure will be readily understood by the following detailed description in conjunction with the accompanying drawings, wherein like reference numerals designate like elements.

Figure 1:
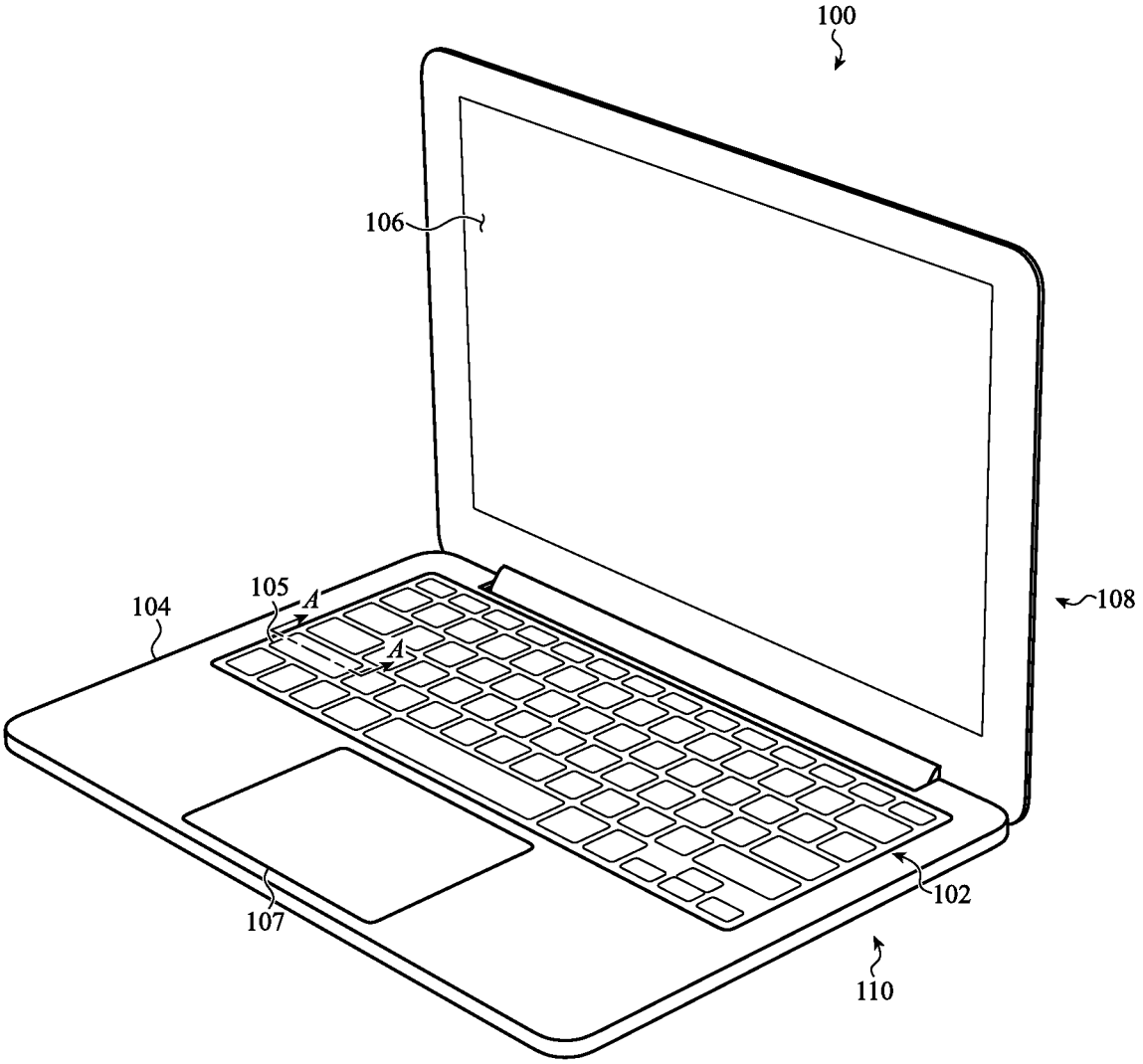
FIG. 1 depicts a sample electronic device including a keyboard.

The use of cross-hatching or shading in the accompanying figures is generally provided to clarify the boundaries between adjacent elements and also to facilitate legibility of the figures. Accordingly, neither the presence nor the absence of cross-hatching or shading conveys or indicates any preference or requirement for particular materials, material properties, element proportions, element dimensions, commonalities of similarly illustrated elements, or any other characteristic, attribute, or property for any element illustrated in the accompanying figures.

Additionally, it should be understood that the proportions and dimensions (either relative or absolute) of the various features and elements (and collections and groupings thereof) and the boundaries, separations, and positional relationships presented therebetween, are provided in the accompanying figures merely to facilitate an understanding of the various embodiments described herein and, accordingly, may not necessarily be presented or illustrated to scale, and are not intended to indicate any preference or requirement for an illustrated embodiment to the exclusion of embodiments described with reference thereto.

DETAILED DESCRIPTION

The description that follows includes sample systems, methods, and apparatuses that embody various elements of the present disclosure. However, it should be understood that the described disclosure may be practiced in a variety of forms in addition to those described herein.

The present disclosure describes systems, devices, and techniques related to an electronic device having various structures configured to control illumination of a peripheral region (or "halo") around a keycap or other input surface. For example, keycaps may have symbols (e.g., glyphs) that can be illuminated to help increase the visibility of the glyphs. However, illuminating the glyphs from below the keycap may create undesirable optical effects, including producing an irregular or non-uniform illumination around the periphery of the keycap.

The structures of the present disclosure may mitigate (mask, conceal, homogenize) such undesirable optical effects. For example, a flexible (moveable) diaphragm may extend outwardly from an underside of the keycap and form a skirt-like member around a periphery of the keycap. This may allow the diaphragm to cover or extend below the gap, and also move or deform as the keycap is depressed. In one embodiment, the diaphragm may be positioned below the gap, and may be formed from a translucent material with an opaque layer positioned on the translucent material below the perimeter of the keycap. The opaque layer may substantially prevent light from beneath the keycap from illuminating the gap, thereby removing or masking an illuminated halo around the keycap. In other cases, the opaque layer and the translucent layer may cooperate to illuminate the gap and produce a desired optical effect around the keycap, including producing an illuminated halo of a specified color, consistency, brightness, contrast, and so on.

The diaphragm may be positioned below the keycap and may cover all or some of a support structure that supports the keycap above a tactile dome. A substrate may be positioned below the support structure and the tactile dome. The substrate may include electrical traces of a key switch, light emitting elements or features (such as a light source or light guide panel, described herein), and/or any other appropriate component or assembly of the electronic device (including a printed circuit board (PCB), feature plate, and so on).

In certain embodiments, the diaphragm may therefore also help protect internal components of a keyboard (e.g., the substrate, tactile dome, support structure, and so on) from potential contaminants, such as moisture, debris, oil, or other particulates. In certain embodiments, the barrier portion extends along a contoured path from a surface of the substrate toward an underside of the keycap. The barrier portion may thus deform when the keycap is depressed, thereby allowing the diaphragm to move and maintain a physical barrier between the internal components and an external environment as the keycap moves between various states of actuation. As described herein, at least one surface of the diaphragm, for example, at the barrier portion, is configured to attract contaminants of the external environment (due in part to a surface texture, material properties, and so on of the diaphragm), which may divert the contaminants from the various components or assemblies of the electronic device.

The diaphragm, as described herein, may produce particular visual effects around the keycap. For example, the diaphragm may extend at least partially over the substrate and form a barrier portion that helps control (e.g., facilitate and/or inhibit) illumination of a gap or peripheral region (halo) around the keycap. For example, the barrier portion may be positioned below a gap between the keycap and the key web, and extend away from a perimeter of the keycap and toward surrounding segments of the key web or other appropriate structures of the electronic device. As such, when the keycap is illuminated from below (e.g., by a light source directing light toward an illuminable symbol of the keycap), the illumination of the gap around the keycap may at least partially depend on the optical and geometric properties of the barrier portion of the diaphragm. Where it is desirable to remove or mask the halo, the diaphragm may substantially prevent light from the light source below from reaching the gap or otherwise illuminating the perimeter of the keycap.

To facilitate the foregoing, in certain embodiments, the diaphragm may be a multilayered structure including a translucent layer, an opaque layer, and/or other appropriate layers used to control propagation or transmission of light through the diaphragm. In other cases, the diaphragm may be a unitary or monolithic structure, as described in greater detail below. The translucent layer may be formed from an elastically deformable material (including silicon, composites, films, woven structures or interlocking fibers, and so on) that allows the passage of light and does not require that the material or layer be transparent, clear, or otherwise free from features that scatter or absorb some amount of light. The term "translucent" may thus generally refer to a material or layer that is optically transparent, partially transparent, or otherwise able to transmit light.

The opaque layer may be connected to the translucent layer along one or more surfaces of the translucent layer and may be configured to impede, mitigate, and/or block the passage of light through the diaphragm. For example, the opaque layer may be an ink, coating, resin, film, woven fiber, or other structure exhibiting an opacity that allows some (but not all) light to pass through the membrane. Additionally or alternatively, the opaque layer may exhibit an opacity that substantially blocks light from passing through the diaphragm (e.g., which may be used to remove or mask the key halo, described herein). In some cases, the opaque layer may be formed directly on one or more surfaces of the translucent layer, for example, through printing, deposition, sputtering, platting, or other appropriate process. In other cases, the opaque layer may be a separate substrate, film, or other layer applied to one or more surfaces of the translucent layer. The opaque layer may be pliable or malleable enough to bend repeatedly without cracking, breaking, or otherwise being damaged. As such, the opaque layer may be used to control illumination around the keycap when the diaphragm (and barrier portion) deforms in response to a key press.

The opaque layer may be positioned on the translucent layer at the barrier portion and/or other portions of the diaphragm situated along and below the perimeter of the keycap. In particular, the opaque layer may extend across or substantially cover the gap below the keycap and the key web. This may allow the membrane to impede or substantially prevent light from below the keycap from reaching or otherwise illuminating the gap and associated perimeter of the keycap. Other portions of the diaphragm may remain substantially unobstructed by the opaque layer or otherwise be configured to allow light to pass therethrough. For example, the diaphragm may have a through portion below the illuminable symbol or it may have a translucent region below the illuminable symbol. Accordingly, the diaphragm may allow the light source to illuminate the illuminable symbol without illuminating the gap or forming a halo around the keycap, as may be desired for a given application.

In some cases, it may be preferable to allow some light to escape through the gap, for example, to provide a controlled halo of illumination around the keycap. In such cases, a diaphragm may define a light guide that redirects light from a light source below the keycap toward the gap in a controlled and uniform manner. The diaphragm may include light extraction features (textures, bumps, dimples, and so on) that may control the light to produce a uniform light distribution or other visual effect. For example, the light extraction features may be asymmetrically or non-uniformly arranged along the diaphragm (e.g., around a periphery of the keycap) to account for the different intensities or quantities of light at different areas around the keycap. In particular, due to the positioning and orientation of a light source within the electronic device, some areas of the gap may be brighter than others. The asymmetrical or non-uniform arrangement of the light extraction features may allow the diaphragm to more uniformly illuminate the gap.

It will be appreciated that while the foregoing describes a keycap and a keyboard, other input devices and structures are contemplated within the scope of the present disclosure. Further, the keycap or input device may be used with any appropriate electronic device and is not limited to a notebook computer or keyboard. Sample devices include other portable and wearable electronic devices, as described herein. As such, the discussion of any electronic device is meant as illustrative only.

Reference will now be made to the accompanying drawings, which assist in illustrating various features of the present disclosure. The following description is presented for purposes of illustration and description. Furthermore, the description is not intended to limit the inventive aspects to the forms disclosed herein. Consequently, variations and modifications commensurate with the following teachings, and skill and knowledge of the relevant art, are within the scope of the present inventive aspects.

FIG. 1 depicts an example electronic device 100 having a housing 104 and a keyboard 102 incorporated therein. The keyboard may be positioned at least partially within the housing 104. The keyboard 102 may include a "stack-up" of layered components that cooperate to initiate an input signal in response to a force input. The keyboard 102 may include one or more diaphragms, such as the diaphragm as discussed above and described in greater detail below. As described herein, the diaphragm (not shown in FIG. 1) may be configured to form a barrier between internal components and assemblies of the keyboard 102 and an external environment. This may shield or protect the internal components and assemblies from dust, debris, oil, and so forth that may be present in the external environment. The diaphragm may also be configured to control illumination of a peripheral region or halo around a keycap or other input surface.

As shown, the electronic device 100 (or "device 100") is a laptop computer, though it can be any suitable electronic device, including, for example, a desktop computer, a smart phone, an accessory, or a gaming device. Moreover, while the keyboard 102 in FIG. 1 is incorporated with the electronic device 100, the keyboard 102 may be separate from the electronic device 100. For example, the keyboard 102 may be a standalone device that is connected (via a cable or wirelessly) to the electronic device 100 as a peripheral input device. The keyboard 102 may also be integrated into another product, component, or device, such as a cover or case for a tablet computer. In such cases, the housing 104 may refer to a housing of any product, component, or device in which the keyboard 102 is integrated or otherwise positioned.

The electronic device 100 may also include a display 106 within the housing 104. For example, the display 106 may be within or otherwise coupled to a first portion 108 of the housing 104 that is configured to pivot relative to a second portion 110 of the housing 104. The keyboard 102 may be within or otherwise coupled to or incorporated with the second portion 110 of the housing 104.

The keyboard 102 includes a set of key assemblies having a keycap or other input surface configured to receive a force input, including a representative key assembly 105. While the instant application describes components of a representative key assembly 105 of a keyboard 102, the concepts and components described herein apply to other depressible input mechanisms as well, including buttons, standalone keys, switches, or the like. Moreover, such keys, buttons, or switches may be incorporated into other devices, including smart phones, tablet computers, or the like. Suitable input mechanisms may also include trackpads, mice, joysticks, buttons, and so on.

For purposes of illustration, FIG. 1 depicts the electronic device 100 as including the keyboard 102, the housing 104, a display 106, and one or more input/output members 107. It should be noted that the electronic device 100 may also include various other components, such as one or more ports (e.g., a charging port, a data transfer port, or the like), communications elements, additional input/output members (including buttons), and so on. As such, the discussion of any computing device, such as the electronic device 100, is meant as illustrative only.

Figure 2A:
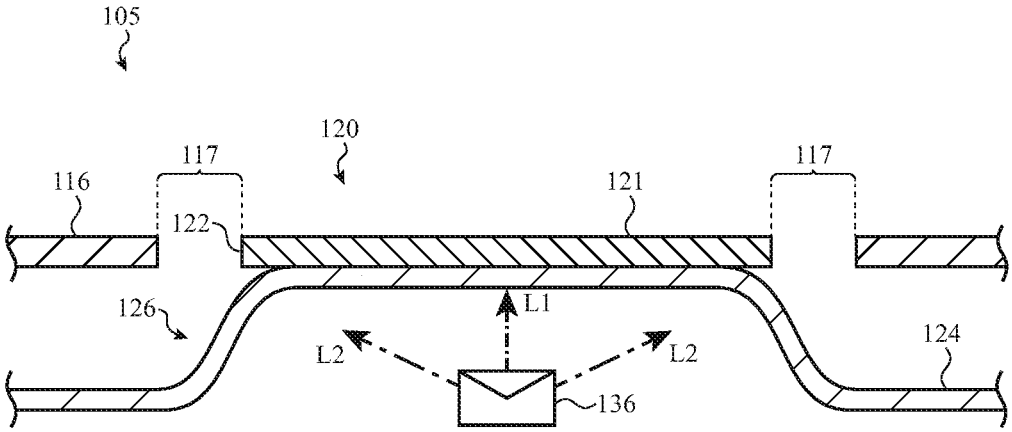
FIG. 2A is a simplified cross-sectional view of a key assembly of FIG. 1 in an unactuated state, taken along line A-A of FIG. 1.
Figure 2B:
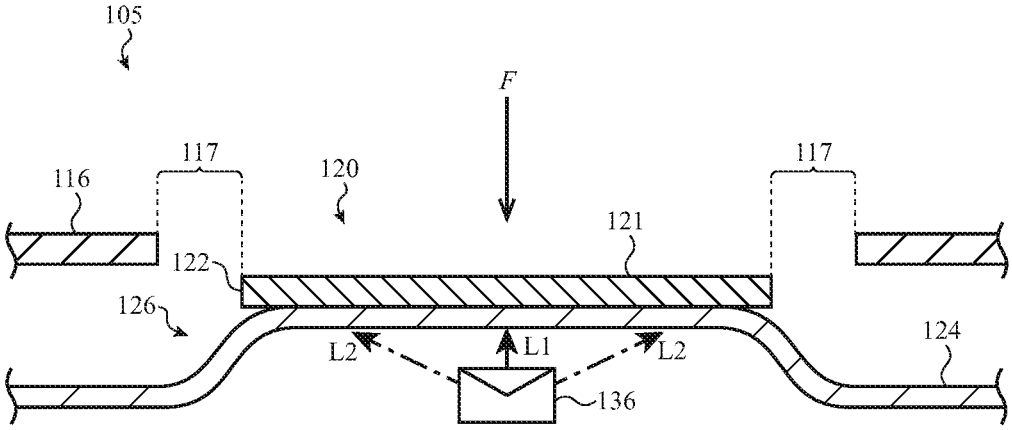
FIG. 2B is a simplified cross-sectional view of the key assembly of FIG. 1 in an actuated state, taken along line A-A of FIG. 1.

FIGS. 2A and 2B depict a simplified cross-sectional view of the key assembly 105, taken along line A-A of FIG. 1. The key assembly 105 may include a diaphragm that controls the illumination of a peripheral region or gap surrounding a keycap. For example, the diaphragm may physically block or impede light emanating from a light source within an electronic device (e.g., electronic device 100 of FIG. 1) from reaching or illuminating the gap. The diaphragm may also form a physical barrier that separates internal components and assemblies from an external environment and moves with a keycap as it is depressed in response to a keypress.

As shown in FIG. 2A, the key assembly 105 may include a keycap 120, a key web 116, a diaphragm 124, and a light source 136. The keycap 120 may be separated from the key web 116 by a gap 117. For example, the key web 116 may form an array of openings that substantially surrounds or frames the keycap 120. The keycap 120 may be positioned in the opening, and the gap 117 may provide physical clearance between the sides of the keycap 120 and the surrounding portion of the key web 116.

The keycap 120 may be configured to move axially or perpendicularly within the gap 117 relative to the key web 116 in response to a keypress or other force input. The diaphragm 124 may be connected to an underside of the keycap 120 and may extend away from a perimeter 122 of the keycap 120 to a region below an adjacent segment of the key web 116. Accordingly, a portion of the diaphragm 124 spans or extends below the gap 117 within the key assembly 105. In the embodiment of FIG. 2A, the keycap 120 is shown in an unactuated or undepressed state.

The keycap 120 may define an illuminable symbol 121. The illuminable symbol 121 may be an indicia, glyph, marking, or the like that defines an alpha numeric character, a punctuation mark, a word, an abbreviation, or any other linguistic, scientific, numeric, or pictographic symbol or set of symbols. Additionally or alternatively, the illuminable symbol 121 may be an area or region of the keycap 120 that is intended to be illuminated by the light source 136, including areas or region that emphasize a location, size, or geometric feature of the keycap 120.

The light source 136 may be used to illuminate the illuminable symbol 121. For example, the light source 136 may be configured to propagate light substantially along a light path L1 toward an underside of the keycap 120 and illuminate the illuminable symbol 121. When used to illuminate the illuminable symbol 121, the light source 136 may also propagate light along a light path L2, which may be representative of diffuse (or reflected) light that propagates generally within the key assembly 105. Left unobstructed, light that propagates along the light path L2 may reach the gap 117 and undesirably illuminate the gap 117 and the perimeter 122 of the keycap 120, including illuminating the gap 117 and/or the perimeter 122 in an uneven or inconsistent manner.

The diaphragm 124 may define a light control layer positioned substantially between the light source 136 and the keycap 120. In particular, the diaphragm 124 may be configured to selectively allow light from the light source 136 to illuminate the keycap 120, the illuminable symbol 121, the perimeter 122, the gap 117, and/or other structures or features of the key assembly 105 positioned above the diaphragm 124. For example, the diaphragm 124 may include a translucent region, hole, opening or other feature that allows light along the light path L1 to travel across or through the diaphragm 124 and illuminate the illuminable symbol 121. The diaphragm 124 may also include an opaque layer or other light control layer or feature positioned along the light path L2 that controls the illumination of the gap 117 and/or the perimeter 122 by the light source 136. In some cases, this may involve substantially preventing the illumination of the gap 117 and/or the perimeter 122 by the light source 136.

To facilitate the foregoing, the diaphragm 124 may include a barrier portion 126. The barrier portion 126 may extend away from the perimeter 122 of the keycap 120 and may be positioned or oriented generally below the gap 117 (or at least between the gap 117 and the light source 136). Broadly, the barrier portion 126 may define a physical boundary or obstacle between internal components and assemblies of the key assembly 105 (such as light source 136) and the gap 117. The barrier portion 126 may thus impede and/or facilitate the propagation of light between the light source 136 and the gap 117 along the light path L2. By impeding and/or facilitating the propagation of light through the gap 117, the barrier portion 126 may be used to control the propagation of light to produce a particular visual effect. The material and geometric properties of the diaphragm 124 at the barrier portion 126 may be tuned to selectively prevent light from reaching the gap 117. For example, the diaphragm 124 may include various inks, coatings, resins, films, and so on at the barrier portion 126 that exhibit an opacity that causes some (or substantially all) of the light of the light path L2 to remain below the diaphragm 124, and thus not illuminate the gap 117 and/or the perimeter 122. In some cases, the barrier portion 126 may extend along a contoured path below the keycap 120, which may facilitate movement of the diaphragm 124 during a key press, as described in greater detail below with respect to FIG. 2B.

The barrier portion 126 may also physically separate the internal components and assemblies of the key assembly 105 and an external environment (such as that at the gap 117). This may allow the barrier portion 126 to protect the internal components and assemblies of the key assembly 105 from moisture, debris, oils, or other contaminants of the external environment. To help divert the contaminants away from the internal components or assemblies, at least one surface of the diaphragm 124 may be configured to attract or retain such contaminants. For example, the diaphragm 124 may be constructed in part from a silicone layer, or other deformable layer, exhibiting a tacky or sticky characteristic that may limit the introduction of the contaminants into the key assembly 105. In some cases, the diaphragm 124 may be a woven structure having interlocking fibers.

At least a portion of the diaphragm 124 is configured to move or deform as the keycap 120 is depressed due to a keypress or other actuation event. In this regard, the diaphragm 124 maintains a physical boundary or barrier between the internal components and assemblies of the key assembly 105 and the gap 117 during the actuation of the keycap 120. To illustrate, as shown in FIG. 2B, the keycap 120 may be positioned in an actuated or depressed state in response to a force input F. A portion of the diaphragm 124 connected to the underside of the keycap 120 may move downward as the force input F causes the keycap 120 to move downward into the key assembly 105. For example, the barrier portion 126 may deform, bend, bow, and so on to accommodate the movement of the keycap 120 caused by the force input F. Despite the keycap 120 being in an actuated or depressed state, the diaphragm 124 remains connected to the underside of the keycap 120 and positioned below the gap 117. Thus, the diaphragm 124 may be used to control illumination of the gap 117 and/or the perimeter 122 for multiple states of actuation of the keycap 120.

Figure 3:
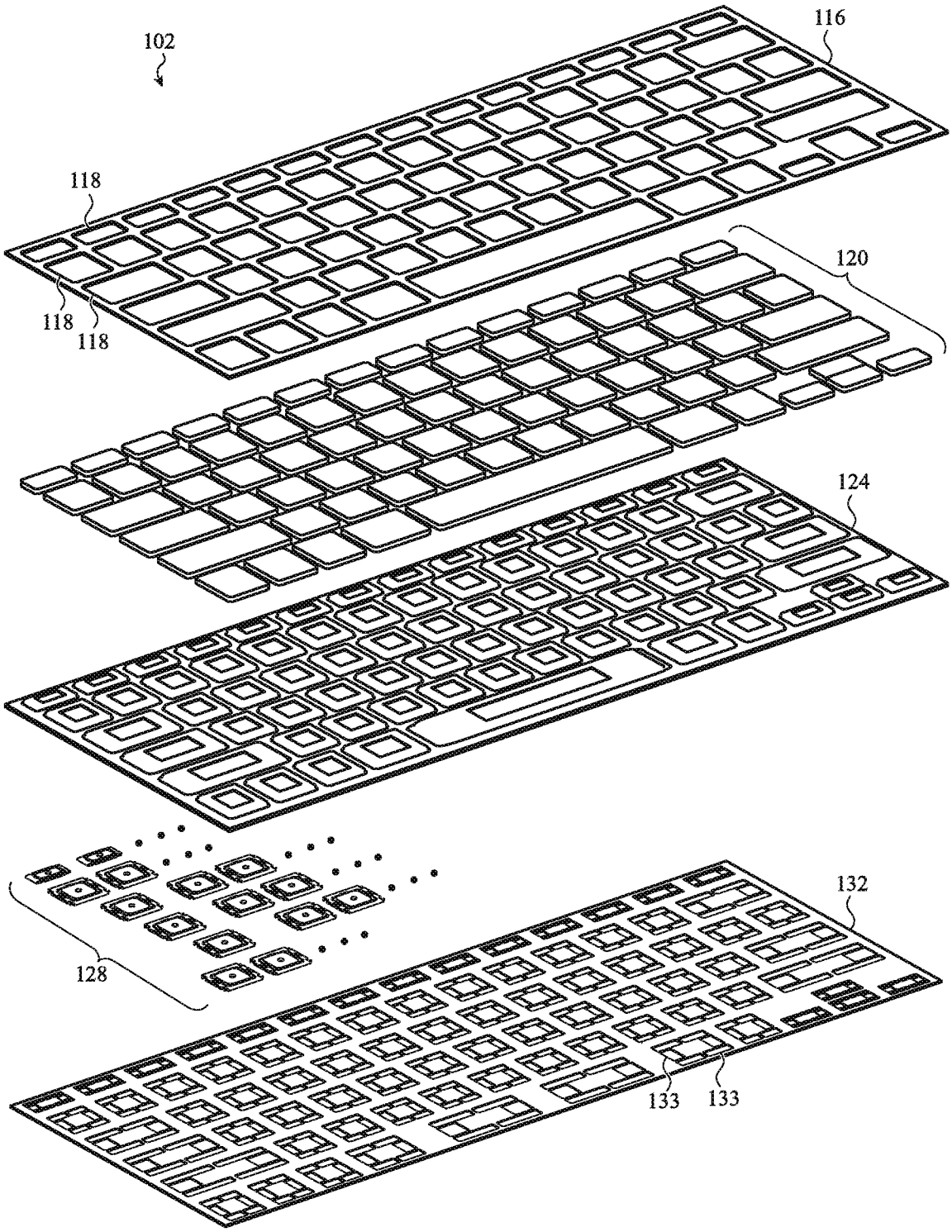
FIG. 3 depicts an exploded view of the keyboard of FIG. 1.

FIG. 3 shows an exploded view of the keyboard 102. The keyboard includes the key web 116, keycaps 120, diaphragm 124, switch assemblies 128, and a substrate 132. As used herein, keycaps 120, switch assemblies 128, and/or other components or assemblies of the key assembly 105 (FIGS. 2A and 2B) may be discussed individually or collectively. It will be understood that a discussion relating to any individual keycap 120 or switch assembly 128 may apply to any other keycap, switch assembly, or so on of the keyboard 102.

The key web 116 may be part of the second portion 110 of the housing 104 (FIG. 1), and may define a group of openings 118 configured to receive keycaps 120 therein. The key web 116 may also include other openings (not shown) for other buttons, input mechanisms, touchpads, microphones, light speakers, and/or other components or assemblies.

The keycaps 120 may be coupled to the switch assemblies 128 and may be configured to be manipulated (e.g., pressed or actuated) by a user to provide input to the electronic device 100. For example, the keycaps 120 may be positioned over a collapsible dome (e.g., dome 131 of FIG. 4) such that when the keycaps 120 are pressed, the collapsible domes are collapsed to actuate the key and close a switch that allows the electronic device 100 to register an input.

The keycaps 120 may include optical elements or materials that are configured to transmit light therethrough. For example, the keycaps 120 may include translucent portions that correspond to (or define) various glyphs or other symbols found on keycaps (such as illuminable symbol 121 of FIG. 2). Light from below the keycap 120 may be transmitted through such portions to illuminate the keycaps 120 and corresponding illuminable symbol 121. Alternatively, the keycaps 120 may have translucent as well as opaque portions. For example, the keycaps 120 may be formed entirely from a translucent material, and may include a substantially opaque painting, coating, or other layer disposed on or along a portion of the keycaps 120 to produce optical regions within the keycaps 120. As another example, the keycaps 120 may be formed with openings, which may be filled with translucent materials to form illuminable symbols on the keycaps 120.

The diaphragm 124 may be coupled to an underside of the keycaps 120. The diaphragm 124 may be a substantially continuous sheet, as shown in FIG. 3; however, this is not required. In other cases, the diaphragm 124 may include or be defined by multiple discrete structures coupled to individual keycaps of the keycaps 120. The diaphragm 124 may form a physical barrier between the switch assemblies 128 and an external environment of the keyboard 102. This may allow the diaphragm 124 to control the illumination of the keycaps 120, the group or openings 118 and so on from a light source positioned within the keyboard 102. The physical barrier defined by the diaphragm 124 may also help block contaminants of the external environment from entering an internal volume of the keyboard 102, which may increase the longevity and durability of the various internal components and assemblies of the keyboard 102, such as the switch assemblies 128. As the keycaps 120 are manipulated (e.g., pressed), a portion of the diaphragm 124 connected to the actuated keycap may correspondingly move and deform.

The switch assemblies 128 may include components that provide mechanical and electrical operations of the keyboard 102. For example, as described herein, the switch assemblies 128 may include a switch housing, a dome, and a support structure (e.g., a hinge having wings that extend in opposing directions, much like the wings of a butterfly, although other support structures are possible). The switch assemblies 128 may be preassembled prior to being coupled to the substrate 132. The switch assemblies 128 may be referred to as input subassemblies. In particular, as described herein, the switch assemblies 128 may be assembled into a modular subassembly prior to being incorporated into a keyboard or other input mechanism. In such cases, the switch assemblies 128 are subassemblies for the overall input mechanism.

The keyboard 102 may also include the substrate 132. The substrate 132 may be a single component (e.g., a single monolithic structure, such as a single circuit board or other substrate), or may be composed of multiple layers. For example, the substrate 132 may include multiple layers including any of printed circuit boards (PCBs), membranes, flexible circuit layers, conductive layers, or the like. Additionally or alternatively, the substrate 132 may be a translucent substrate that includes electrical traces of key switch (not shown). As such, the substrate 132 may be used as both a light guide and to detect actuation of the keycaps 120. The substrate 132 may also be coupled with a light source or light emitting elements, such as a light emitting diode (LED), micro-LED, liquid crystal display (LCD), organic light emitting diode (OLED), fluorescent light, and so on. Accordingly, the substrate 132, and various components thereof, may be used to illuminate the keycaps 120 and/or the group of openings 118, as may be appropriate for a given application. The substrate 132 may be positioned within and/or coupled to the housing 104.

The switch assemblies 128 may be coupled to the substrate 132. For example, the switch assemblies 128, or a portion thereof, may be glued, staked, screwed, or otherwise coupled to the substrate 132. The substrate 132 may be a circuit board (e.g., a printed circuit board), a housing component of an electronic device, or any other component or substrate to which the switch assemblies 128 may be coupled.

The substrate 132 may include electrical contacts that interact with the domes 131 of the switch assemblies 128 to detect actuations of the keycaps 120. For example, the substrate 132 may be a printed circuit board with conductive traces thereon. When a switch assembly 128 is coupled to the circuit board, the dome 131 may be positioned such that, when that key is actuated, the dome 131 forms or completes an electrical path between two conductive traces.

The substrate 132 also defines a group of openings 133. Some of the group of openings 133 may receive components of the switch assemblies 128 therein. For example, portions of a support structure or of the keycaps 120 may extend into an opening 133 when the keycaps 120 are actuated or depressed. Some of the group of openings 133 may also or instead provide clearance between components of the switch assemblies 128 and the substrate 132, such that debris or other contaminants do not interfere with the movement of the keycaps 120.

Figure 4:
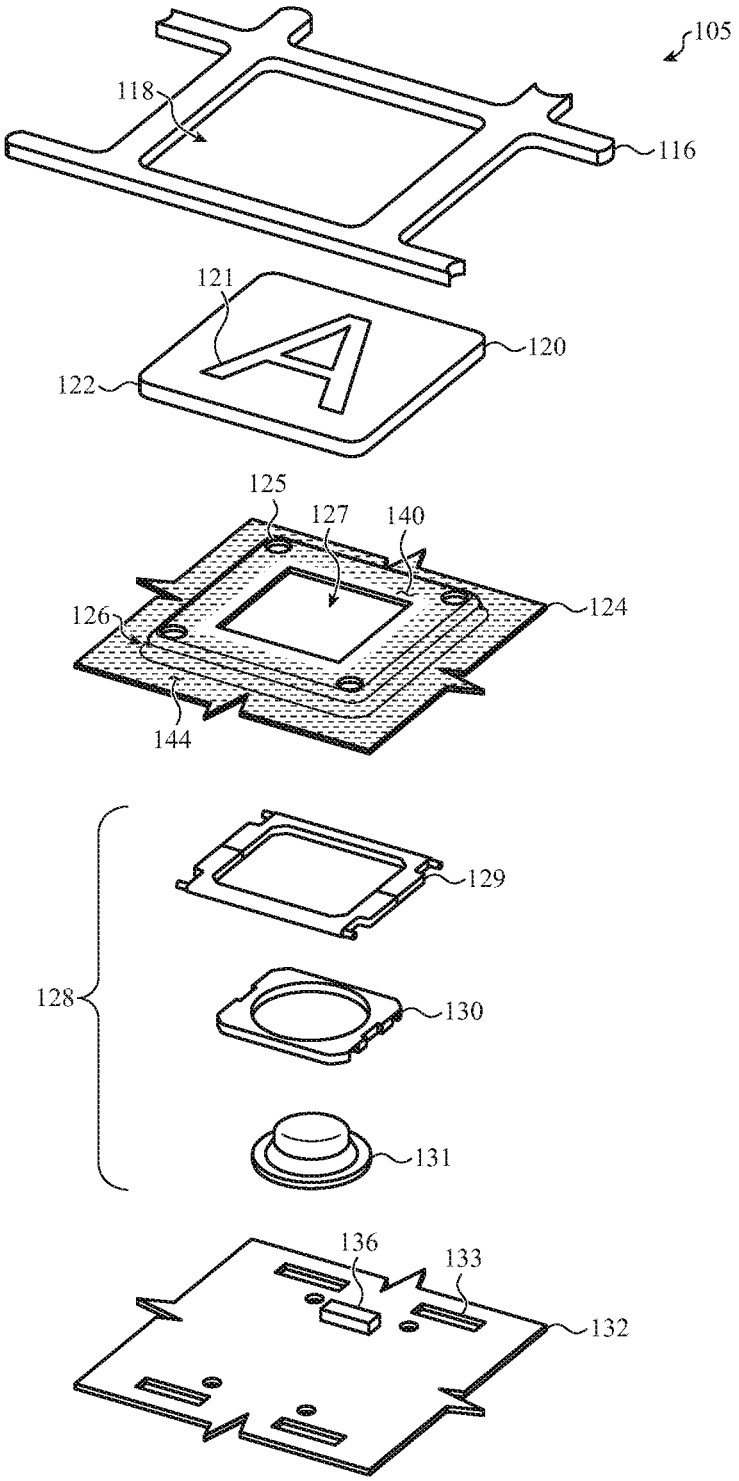
FIG. 4 depicts an exploded view of a key assembly of FIG. 1.

FIG. 4. shows an exploded view of the representative key assembly 105. It will be appreciated that the keyboard 102 (FIGS. 1 and 3) may include multiple key assemblies corresponding to each individual key or keycap of the keyboard. As such, the discussion of the representative key assembly 105 may apply to other key assemblies or input mechanisms of the electronic device 100.

As shown in the embodiment of FIG. 4, a keycap 120 having an illuminable symbol 121 may be positioned with an opening 118 of a key web 116. The keycap 120 may be separated from the key web 116 (inside of the opening 118) by a gap 117 (FIGS. 2A and 2B). The gap 117 may be defined between a perimeter 122 of the keycap 120 and a portion of the key web 116 that surrounds the keycap 120. In this manner, the gap 117 may extend around or encircle the keycap 120 within the opening 118. This may allow the keycap 120 to move axially within the opening 118 substantially unobstructed when depressed. In other embodiments, the gap 117 may extend around the keycap 120 without encircling the keycap 120, which may be appropriate for some input mechanisms in which a portion of an input component is attached to an enclosure or key web.

The illuminable symbol 121 may be illuminated by a light source 136 positioned below the keycap 120. For example, the light source 136 may propagate light toward the keycap 120 and cause the illuminable symbol 121 to illuminate. As shown in FIG. 4, the light source 136 may be positioned along the substrate 132. However, in other cases, the light source 136 may be a separate structure or component and may be positioned substantially anywhere within the keyboard 102, including being positioned offset from the keycap 120. The substrate 132 (or keyboard 102 more generally) may include multiple light sources 136, such as at least one light source for each key assembly 105, or any other appropriate number or distribution of light sources. The light source 136 may also be, or define a portion of, a light guide or a light pipe that guides or directs light from a remote light source to a location where the light source 136 is depicted in FIG. 4. The light source 136, or a terminal end of a light guide or light pipe, may be positioned along the substrate 132 such that when the switch assembly 128 is attached to the substrate 132, the light source is positioned proximate the illuminable symbol 121.

When used to illuminate the illuminable symbol 121, light from the light source 136 may also propagate toward the gap 117 and/or the perimeter 122 of the keycap 120. This may create an undesirable illumination of the perimeter 122, which may resemble an illuminated halo around the keycap 120. Light from the light source 136 may also appear non-uniform or irregular at the gap 117. As such, a diaphragm 124, described herein, is positioned substantially between the light source 136 and the keycap 120. Light from the light source 136 may therefore propagate through a layer or opening in the diaphragm 124, thereby allowing the diaphragm 124 to control illumination of the gap 117, opening 118, the keycap 120, the illuminable symbol 121, the perimeter 122, and/or any other structure or feature positioned above the diaphragm 124.

To facilitate the foregoing, the diaphragm 124 may be a multi-layered structure that is pliable enough to deform, bend, bow or otherwise move with movements of the keycap 120 while also blocking or limiting the passage of light through the gap 117. In this regard, the diaphragm 124 may be constructed from any appropriate material (e.g., silicon, rubber, metal, fibers, composites, and so on) that exhibits sufficiently elastic characteristics. For example, the diaphragm 124 may be sufficiently elastic or resilient such that it does not permanently deform or break from an applied force caused by movement of the keycap 120 (e.g., the diaphragm 124 may substantially return to an original or un-deformed shape when the keycap 120 returns to an unactuated state after a keypress).

In one embodiment, shown in FIG. 4, the diaphragm 124 may include a translucent layer 140. The translucent layer 140 may be a flexible silicone material, however, other materials are possible. The translucent layer 140 may be a structural component of the diaphragm 124 in that the translucent layer 140 may define various contours, features, openings, and so on of the diaphragm 124 (such as the barrier portion 126). The translucent layer 140 may generally allow the passage of light, and it is not a requirement that the material or layer be transparent, clear, or otherwise free from features that scatter or absorb some amount of light. As such, light from the light source 136 may pass through the translucent layer 140 and illuminate the illuminable symbol 121. For example, the translucent layer 140 may be positioned partially or fully along an underside of the keycap 120 and light from the light source 136 may propagate through a thickness of the translucent layer 140 and illuminate the illuminable symbol 121. Additionally or alternatively, the translucent layer 140 may define one or more through portions below the keycap 120 (e.g., through portion 127) that may allow light to pass through the diaphragm 124 substantially unobstructed and illuminate the illuminable symbol 121.

In order to control or block the passage of light, at least a portion of the diaphragm 124 may be opaque. In this regard, in the embodiment of FIG. 4, the diaphragm 124 includes an opaque layer 144 positioned on the translucent layer 140. As used herein, an "opaque" layer may refer to a material that blocks some (but not necessarily all) light from passage therethrough. For example, the opaque layer 144 may be an ink, resin, dye, film, and so on having an opacity that impedes the propagation of light across a portion of the diaphragm 124. In some cases, the opaque layer 144 may be configured to substantially block light. This may allow the diaphragm 124 to remove or mask an illuminated halo around the keycap 120 that may be otherwise visible when the light source 136 is active. For example, the opaque layer 144 may be positioned on the translucent layer 140 below the gap 117 and/or between the gap 117 and the light source 136, thereby blocking or impeding illumination of this components and features by the light source 136.

The opaque layer 144 may be formed on or coupled with the translucent layer 140 in any appropriate manner. For example, the opaque layer 144 may be formed directly on one or more surfaces of the translucent layer 140, for example, through printing, deposition, sputtering, platting, or other appropriate process. In other cases, the opaque layer 144 may be a separate substrate, ink, film, or other layer applied to one or more surfaces of the translucent layer 140. Generally, the opaque layer 144 may have a thickness that is less than a thickness of the translucent layer 140. For example, the opaque layer 144 may have a thickness that is generally less than or equal to 10 microns. The translucent layer 140 may be thicker than the opaque layer 144 and have a thickness of less than or equal to 60 microns. It will be appreciated that other dimensions and geometries are possible, including configurations in which a thickness of the opaque layer 144 is greater than 10 microns and a thickness of the translucent layer 140 is greater than 60 microns.

The diaphragm 124 may also include a barrier portion 126. The barrier portion 126 may extend from the underside of the keycap 120 below the gap 117 and toward the substrate 132. The opaque layer 144, in one embodiment, may be positioned on the translucent layer 140 at the barrier portion 126 in order to block or impede the propagation of light through the diaphragm 124 at the barrier portion 126. The barrier portion 126 may be constructed in order to accommodate the switch assemblies 128 positioned below the keycap 120. For example, the barrier portion 126 may form a curve from the underside of the keycap 120 to a surface of the substrate 132. The switch assembly 128 may be positioned at least partially under the curve formed by the barrier portion 126 or otherwise be positioned along the diaphragm 124. The barrier portion 126 may also be configured to accommodate movement of the keycap 120 and/or the switch assembly 128. For example, as the keycap 120 is depressed, the diaphragm 124 may deform or bend at the barrier portion 126.

The switch assembly 128 may include multiple components and assemblies used to support the keycap 120 and trigger a switch event in response to a key press or other input received at the keycap 120. As shown in the embodiment of FIG. 4, the switch assembly may include a support structure 129, a switch housing 130, and a dome 131; however, other components and features are also contemplated herein. The support structure 129 may be pivotally coupled to an underside of the keycap 120 and the switch housing 130 and used to support and guide movements of the keycap 120. The switch housing 130 may thus be a structural component of the switch assembly 128 that is positioned below the keycap 120 and is physically coupled to the substrate 132. The dome 131 may be positioned within an opening of the switch housing 130 and used to produce tactile feedback in response to a key press. For example, the keycap 120 may impact the dome 131 in response to a keypress, thereby causing the dome 131 to collapse or buckle. In some cases, the collapsing of the dome 131 may cause electrical contacts, traces, and/or other switch elements of the substrate 132 to close, thereby triggering the switch event.

Various materials may be used to form the components and assemblies of the switch assembly 128, including translucent materials. For example, one or more of the support structure 129, the switch housing 130, and/or the dome 131 may have a translucent region that allows light from the light source 136 to propagate through the switch assembly 128 and illuminate the illuminable symbol 121 of the keycap 120. In other cases, one or more of the support structure 129, the switch housing 130, and/or the dome 131 may be constructed from a metal material, opaque plastic, or other light blocking or redirecting material. The arrangement and composition of translucent and/or opaque materials used to form the switch assembly 128 may be at least partially based on the particular illuminable symbol 121 of the keycap 120 (e.g., as may be the case where the switch housing 130 defines translucent region corresponding to an outline of the illuminable symbol 121 of the keycap 120).

Broadly, as described herein, the diaphragm 124 may form a physical barrier between the switch assembly 128 and the gap 117, thereby inhibiting contaminants of an external environment from impacting the switch assembly 128. The switch assembly 128 may thus be at least partially covered by the diaphragm 124. As one example, the barrier portion 126 may extend about a periphery of the support structure 129. In some embodiments, the barrier portion 126 also may extend at least partially over the support structure 129 such that a portion of the diaphragm 124 is positioned substantially between the support structure 129 and the underside of the keycap 120. The diaphragm 124 may thus define a series of coupling passages 125 or other openings that may receive pins, studs, clips, or other engagement features of the support structure 129 used to pivotally couple with the underside of the keycap 120. In this manner, the diaphragm 124 may remain connected to the underside of the keycap 120 (forming the physical barrier beneath the gap) while the support structure 129 is pivotally coupled with the underside of the keycap 120 and guides downward movement in response to a keypress.

Figure 5:
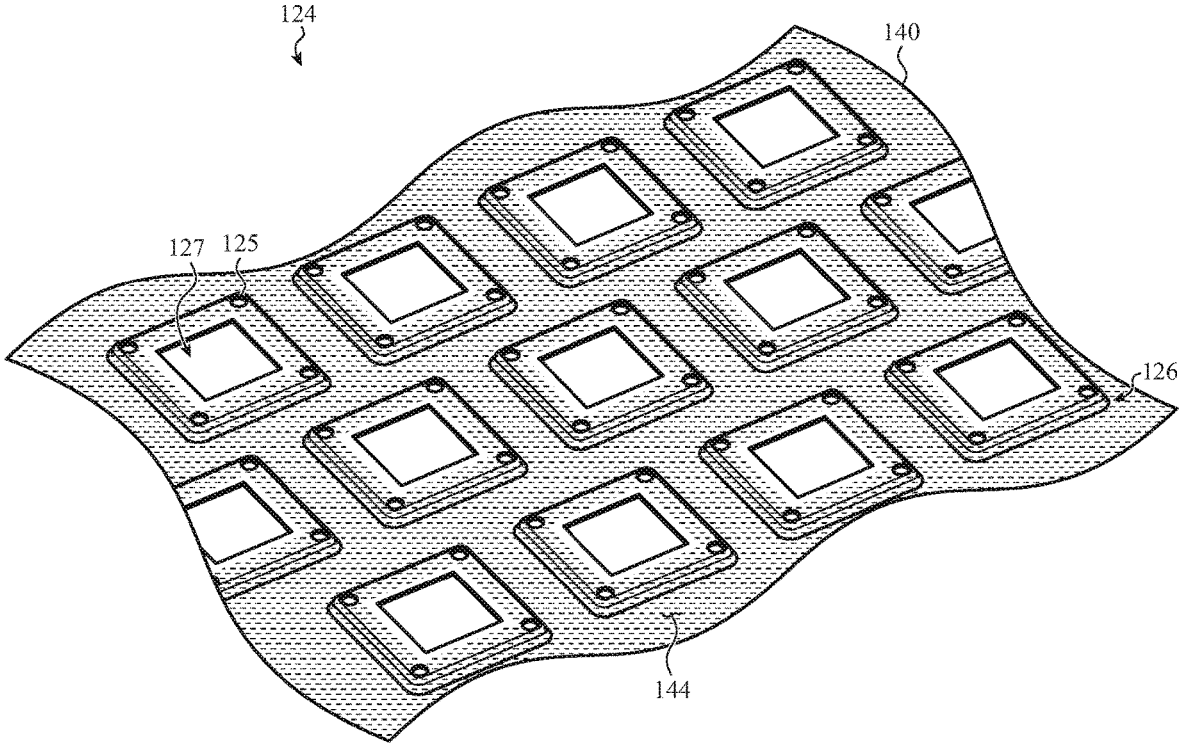
FIG. 5 depicts an example diaphragm.

As described herein, the diaphragm 124 may be a substantially continuous sheet that extends over or about multiple key assemblies of the keyboard 102 (FIG. 1). FIG. 5 depicts a detail view of the diaphragm 124 that may be used to extend over or about multiple key assemblies of the keyboard 102. For example, diaphragm 124 may include groups of features that control illumination of corresponding keycaps of the keyboard 102. As shown in FIG. 5, the diaphragm 124 may include a group of barrier portions 126'. Each barrier portion of the group of barrier portions 126' may correspond to a physical location of a key assembly of the keyboard 102. In particular, distinct switch assemblies may be positioned below or along the individual barrier portions of the group of barrier portions 126' and keycaps having an illuminable symbol may be positioned above. Accordingly, the diaphragm 124 may be used to control the illumination of multiple key assemblies of the keyboard 102.

To facilitate the foregoing, the opaque layer 144 depicted in FIG. 5 may be positioned on the translucent layer 140 at each barrier portion of the group of barrier portions 126'. The opaque layer 144 may also be positioned on the translucent layer 140 between individual barrier portions of the group of barrier portions 126'. This may further help prevent light leakage within the keyboard 102. For example, the diaphragm 124 may be positioned above a light guide and the opaque layer 144 may help prevent light from the light guide from propagating toward a top surface of the keyboard 102 between the individual barrier portions of the group of barrier portions 126'.

At least some of the translucent layer 140 may remain free or otherwise unobstructed by the opaque layer 144. For example, the translucent layer 140 may be free of the opaque layer 144 along a surface below or aligned with the underside of the keycap 120. The absence of the opaque layer 144 along this surface may help facilitate illumination of the illuminable symbol 121. For example, light may travel from a light source below the keycap 120 through the translucent layer 140 and illuminate the illuminable symbol 121. Through portions 127 may optionally be defined in the translucent layer 140, which may allow the light to reach the illuminable symbol without traversing or covering a thickness of the diaphragm 124.

Figure 6A:
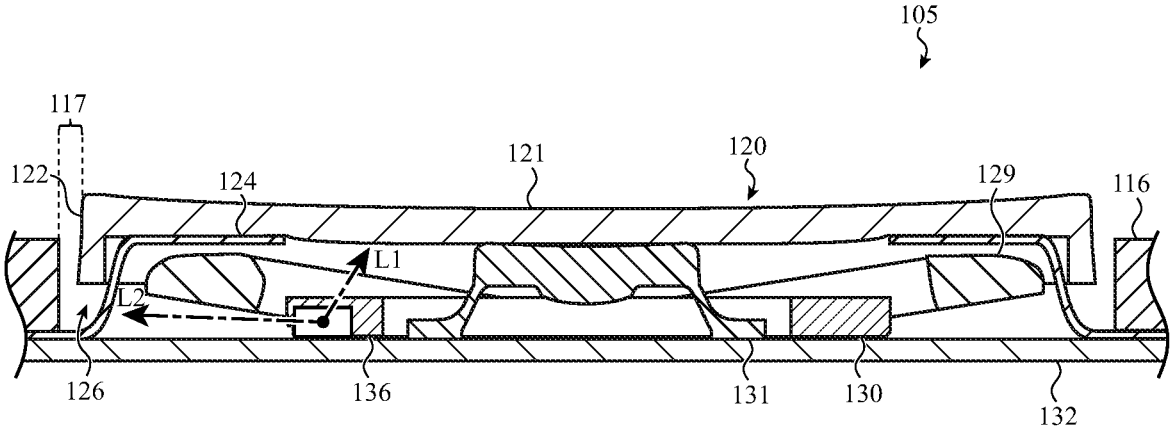
FIG. 6A depicts a cross-sectional view of the key assembly of FIG. 1, taken along line A-A of FIG. 1.

FIG. 6A is a cross-sectional view of the key assembly 105 of FIG. 1, taken along line A-A of FIG. 1. As illustrated, the diaphragm 124 is shown extending away from the perimeter 122 of the keycap 120 and extending across or spanning the gap 117 within the key assembly 105. A portion of the diaphragm 124 is connected to an underside of the keycap 120 and extends a long a curve toward the substrate 132. The diaphragm 124 may thus define a barrier portion 126 below the gap 117, which separates the internal components and assemblies of the key assembly 105 from an external environment present at the gap 117. The barrier portion 126 may also control the propagation of light from within the key assembly 105 toward the gap 117 and/or the perimeter 122 of the keycap 120.

As shown in FIG. 6A, a light source 136 may be positioned below the keycap 120. The light source 136 may be configured to propagate light toward the underside of the keycap 120 and illuminate an illuminable symbol 121. For example, in one embodiment, the light source 136 may propagate light along the light path L1, described herein, which passes through the diaphragm 124 (at a through portion, translucent layer, or the like) and illuminates the illuminable symbol 121. The light source 136 may also propagate light along light path L2, which may be directed generally toward the gap 117, the perimeter 122 of the keycap 120 or other region of the key assembly 105 distinct from a region of the illuminable symbol 121.

The barrier portion 126 may be positioned along the light path L2 and below the gap 117. As described herein, barrier portion 126 may be used as a light control layer that selectively allows light to pass through the diaphragm 124. As such, the barrier portion 126 may impede or block the propagation of light along the light path L2, thereby mitigating or substantially preventing the illumination of the gap 117 and/or the perimeter 122 by the light source 136.

Figure 6B:
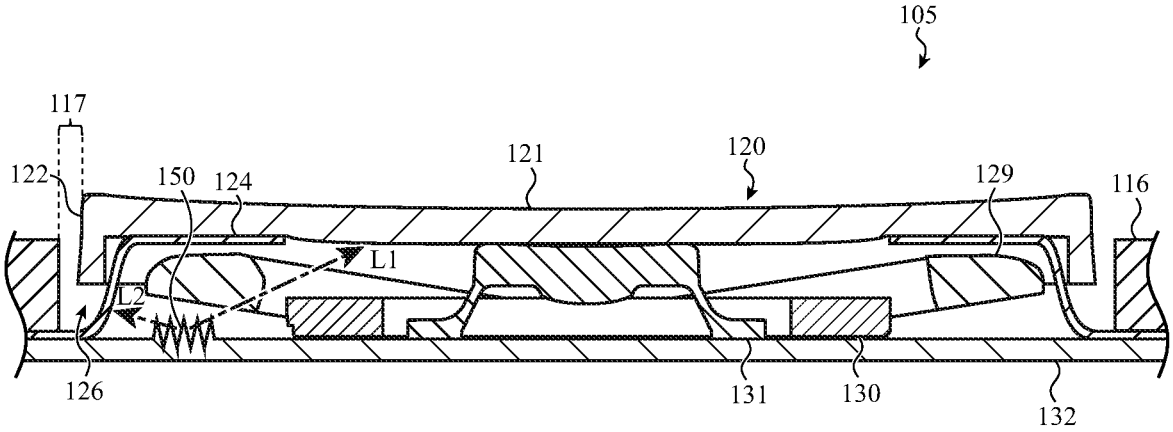
FIG. 6B depicts a cross-sectional view of another embodiment of the key assembly of FIG. 1, taken along line A-A of FIG. 1.

FIG. 6B is a cross-sectional view of another embodiment of the key assembly 105 of FIG. 1, taken along line A-A of FIG. 1. In the embodiment of FIG. 6B, the illuminable symbol 121 may be illuminated by a light guide panel (not shown) positioned below the keycap 120. The light guide panel may be used to redirect light from another location of the keyboard 102 to the key assembly 105 and expel light toward the keycap 120 for illumination of the illuminable symbol.

To facilitate the foregoing, the key assembly 105 may include a substrate 132'. The substrate 132' may be a substantially translucent structure having internal reflective properties that allow light to propagate along a length of the substrate 132'. The substrate 132' may include or define an array of light extraction features 150. The array of light extraction features 150 may be textured features (including bumps, dimples, grooves, and so on) having a distinct index of refraction from that of a body of the substrate 132'. As such, the array of light extraction features 150 may be configured to extract light from the substrate 132' and illuminate the illuminable symbol 121.

As shown in the embodiment of FIG. 6B, the array of light extraction features 150 may cause light from the substrate 132' to propagate along the light path L1. As described above with respect to FIG. 6A, light along the light path L1 may be directed toward an underside of the keycap 120 and illuminate the illuminable symbol 121. The array of light extraction feature 150 may also cause light from the substrate 132' to propagate along the light path L2. Substantially analogous to the manner described with respect to FIG. 6A, the barrier portion 126 may impede or block the propagation of light along the light path L2 and thereby mitigate or substantially prevent the illumination of the gap 117 and/or the perimeter 122 by the light source 136.

Figure 6C:
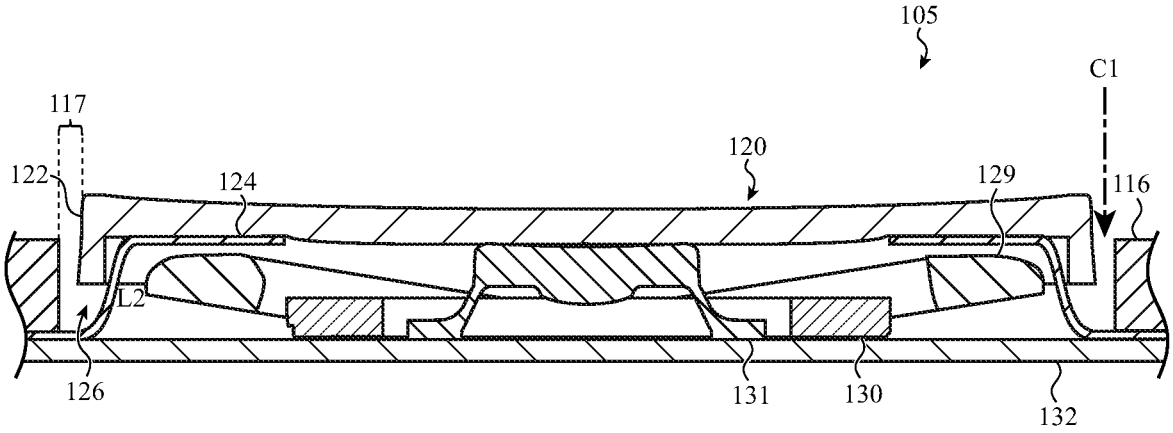
FIG. 6C depicts a cross-sectional view of another embodiment of the key assembly of FIG. 1, taken along line A-A of FIG. 1.

FIG. 6C is a cross-sectional view of another embodiment of the key assembly 105 of FIG. 1, taken along line A-A of FIG. 1. In the embodiment of FIG. 6C, the diaphragm 124 forms a physical barrier between internal structures and assemblies of the key assembly 105 (e.g., the switch housing 130, the dome 131, the substrate 132, and so on) and dust, debris, oils, moisture, and/or other contaminants of an external environment. For example, FIG. 6C shows the barrier portion 126 of the diaphragm 124 positioned below the perimeter 122 of the keycap 120 and spanning the gap 117 that separates the keycap 120 and the key web 116. The barrier portion 126 may thus block or otherwise mitigate contaminant ingress at the gap 117.

As shown in the embodiment of FIG. 6C, contaminants may travel toward the key assembly 105 along a contaminant path C1, among other possibilities. The contaminant path C1 may be a generalized representation of various elements of an external environment of the key assembly 105 that may, in some cases, contribute to the degradation of the internal structures and assemblies of the key assembly 105. This may include dirt, sand, dust, oils, moisture and so forth.

The barrier portion 126 may be positioned along, or partially along, the contaminant path C1. The barrier portion 126 may thus block elements of the external environment from proceeding, for example, through the gap 117 and below the keycap 120 (or key web 116 more generally). This may be facilitated by attaching the diaphragm 124 to the key assembly 105. For example, the diaphragm 124 may be attached to an underside of the keycap 120 and/or substantially about its entire perimeter. The diaphragm 124 may also be attached to a portion of the key web 116, and may extend below an exterior surface of the key web 116. This may limit the potential ingress pathways that contaminants may otherwise use to reach the internal structures and assemblies of the key assembly 105, such as the switch housing 130, the dome 131, the substrate 132, among other internal structures and assemblies. Any of the diaphragms described herein with respect to any embodiment may likewise be used as a barrier against contaminants, and such diaphragms may generally be positioned and/or secured as described with respect to FIG. 6C.

Figure 7A:
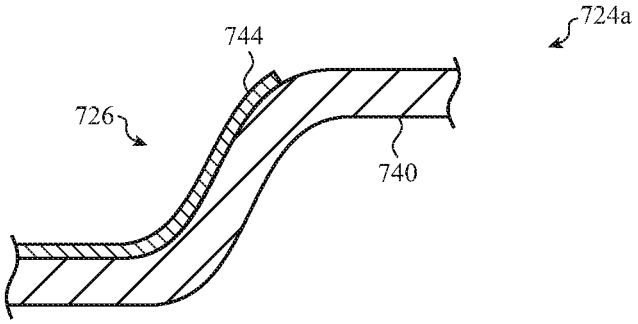
FIG. 7A depicts a cross-sectional view of an embodiment of the membrane of FIG. 4.
Figure 7B:
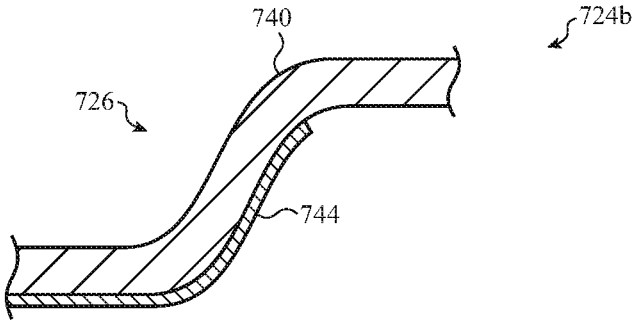
FIG. 7B depicts a cross-sectional view of another embodiment of the membrane of FIG. 4.
Figure 7C:
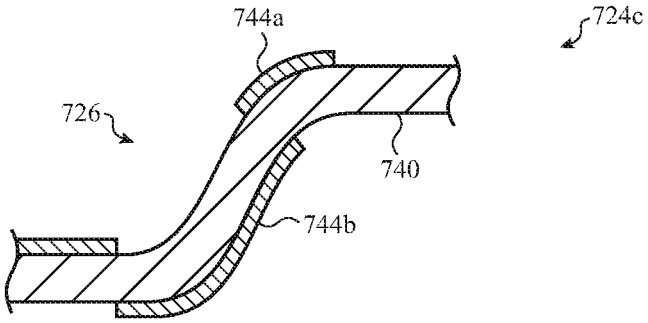
FIG. 7C depicts a cross-sectional view of another embodiment of the membrane of FIG. 4.

FIGS. 7A-7C depict sample embodiments of a diaphragm, such as the diaphragm 124 described above. As described herein, diaphragms of the present disclosure may have opaque regions or layers that impede or block the propagation of light therethrough. Broadly, the opaque layers or regions may be positioned on, or formed into, any appropriate surface of the diaphragm. In this regard, FIGS. 7A-7C depict sample diaphragms 724*a*-724*c* having opaque layers positioned along one or both of a top surface of a translucent layer. It will be appreciated, however, that the sample diaphragms 724*a*-724*c* may be substantially analogous to the diaphragm 124 described above with respect to FIGS. 1-6B. For example, the diaphragms 724*a*

724c may be used to form a physical barrier between internal components of a key assembly and an external environment; and, as shown in FIGS. 7A-7C, they may include a barrier portion 726, a translucent layer 740, and an opaque layer 744.

With reference to FIG. 7A, a diaphragm 724*a* is shown having an opaque layer 744 positioned along the top surface of a translucent layer 740. The opaque layer 744 is positioned along the top surface of the translucent layer 740 at the barrier portion 726. This may allow the barrier portion 726 to impede or block the propagation of light through the diaphragm 724*a*.

With reference to FIG. 7B, a diaphragm 724*b* is shown having an opaque layer 744 positioned along a bottom surface, opposite the top surface, of the translucent layer 740. The opaque layer is positioned along the bottom surface of the translucent layer 740 at the barrier portion 726. This may allow the barrier portion 726 to impede or block the propagation of light through the diaphragm 724*b*.

With reference to FIG. 7C, a diaphragm 724*c* is shown having a first opaque layer 744*a* and a second opaque layer 744*b*. The first opaque layer 744*a* may be positioned along a top surface of the translucent layer 740 and the second opaque layer 744*b* may be positioned along a bottom surface of the translucent layer 740. At least one of the first and second opaque layers 744*a*, 744*b* may be positioned along the respective top or bottom surface of the translucent layer 740 at the barrier portion 726. This may allow the barrier portion 726 to impede or block the propagation of light through the diaphragm 724*c*.

Figure 8A:
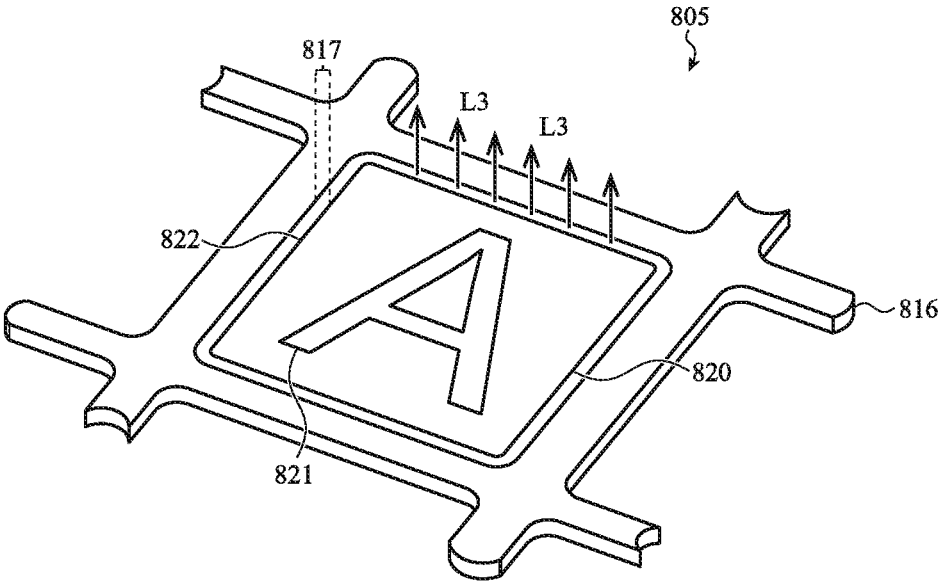
FIG. 8A depicts a key assembly illuminated between a perimeter of a keycap and a surrounding portion of a key web.
Figure 8B:
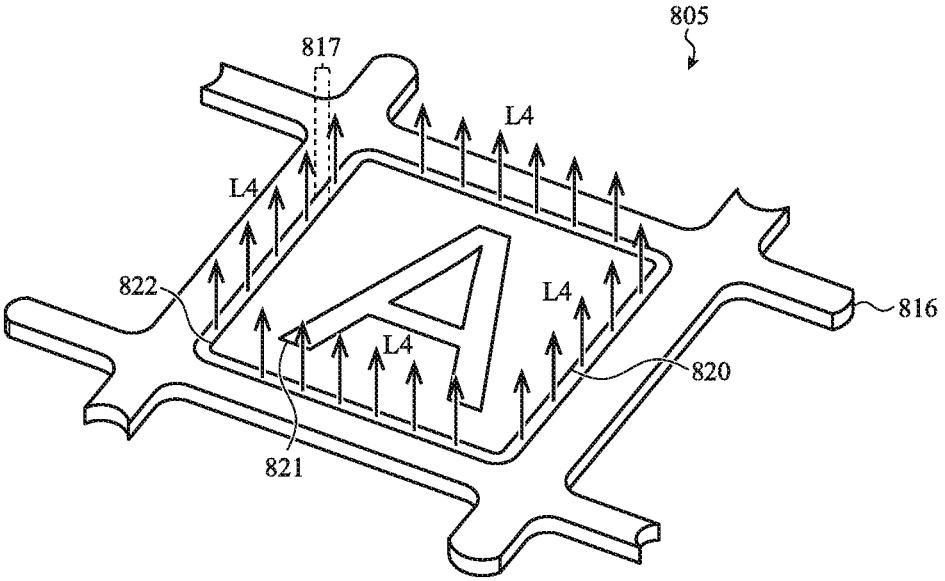
FIG. 8B depicts a key assembly illuminated between a perimeter of a keycap and a surrounding portion of a key web.

FIGS. 8A and 8B depict sample embodiments of a key assembly 805. It will be appreciated that the key assembly 805 may be substantially analogous to the key assembly 105 described above with respect to FIGS. 1-6B. For example, the key assembly 805 may be used to trigger a switch event in response to a keypress or other input received along a keycap. In this regard, analogous to the components described in relation to the embodiments of FIGS. 1-6B, the key assembly 805 may include a keycap 820, an illuminable symbol 821, a perimeter 822 of the keycap 820, a key web 816, and a gap 817 that separates the perimeter from the key web 816.

As described herein, a light source positioned below the keycap 820 may be used to illuminate the illuminable symbol 821. At least some light from the light source may be directed toward the gap 817. Left unmitigated, this may illuminate a portion of the perimeter 822 of the keycap 820. For example, as shown in FIG. 8A, light from below the keycap 820 may propagate along a light path L3. The light path L3 may extend along a localized section of the perimeter 822 (which may correspond to a position or directionality of the light source within the key assembly 805).

In some cases, however, it may be desirable to substantially uniformly illuminate the perimeter 822 (or produce another desired optical effect around the keycap 820), thereby creating an illuminated halo around the keycap 820. The diaphragms of the present disclosure may, in some embodiments, be used to redirect light from the light source along the perimeter 822 and produce the desired optical effect. For example, in the embodiment of FIG. 8B, the key assembly 805 may include a diaphragm (not shown in FIG. 8B) positioned below the keycap 820. The diaphragm may redirect light from below the keycap 820 such that it propagates along a light path L4. For example and as described in greater detail below with respect to FIGS. 9A and 9B, the diaphragm may define a light guide optically coupled with the light source and configured to selectively expel light to produce the light path L4. The light path L4 may extend substantially around the perimeter 822 of the keycap 820. In some embodiments, the light path L4 may illuminate the perimeter 822 with a substantially consistent brightness, contrast, color, and/or other optical characteristic, as may be appropriate for a given application.

Figure 9A:
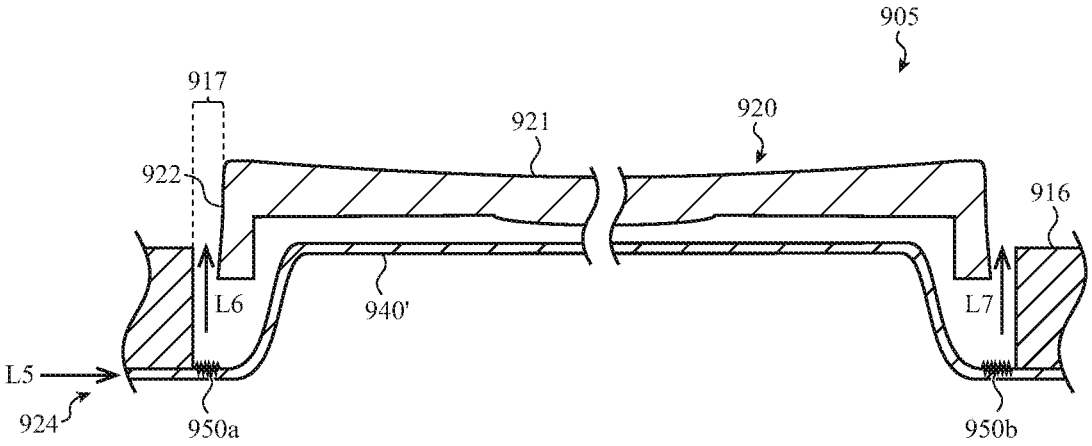
FIG. 9A depicts an embodiment of an example membrane configured to illuminate a periphery of a keycap.
Figure 9B:
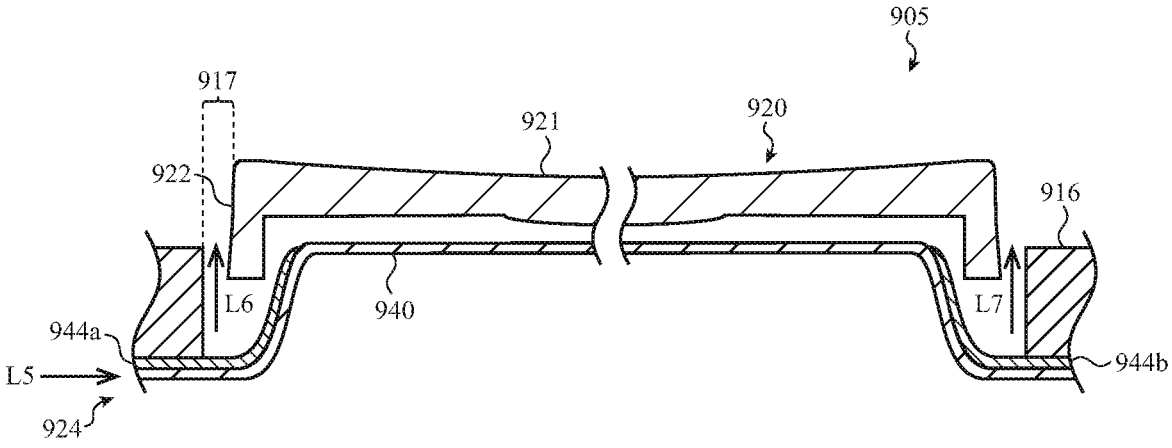
FIG. 9B depicts another embodiment of an example membrane configured to illuminate a periphery of a keycap.

FIGS. 9A and 9B depict a cross-sectional view of sample embodiments of a key assembly 905. It will be appreciated that the key assembly 905 may be substantially analogous to the key assemblies 105 and 805 described above with respect to FIGS. 1-8B. For example, the key assembly 905 may be used to trigger a switch event in response to a keypress or other input received along a keycap. In this regard, analogous to the components described in relation to the embodiments of FIGS. 1-8B, the key assembly 905 may include: a key web 916; a gap 917; a keycap 920; an illuminable symbol 921; a perimeter 922 of the keycap 920; a diaphragm 924; a translucent layer 940; and optionally one or more translucent layers 944*a*, 944*b*.

The diaphragm 924 may be used as a light guide that channels light from within the keyboard 102 (FIG. 1) to the gap 917. For example, one or more translucent layers or regions of the diaphragm 924 may be optically coupled with a light source (e.g., such as the light source 136 described with respect to FIG. 2) and exhibit internally reflective characteristics such that light from the light source propagates within the diaphragm 924 (along a light path L5) to another location of the keyboard 102 (such as to the key assembly 905). Light propagating within the diaphragm 924 may therefore be expelled into and along the gap 917 in order to illuminate the perimeter 922 of the keycap 920. The brightness or intensity of the light that propagates within the diaphragm 924, however, may vary as a function of a position of the light source within the keyboard 102. For example, the brightness or intensity of the propagating light along the light path L5 may fade along a length of the diaphragm 924. As such, in order to substantially uniformly illuminate the gap 917 and/or perimeter 922 of the keycap 920, the amount of light expelled from the diaphragm 924 along the gap 917 may also be varied to account for the varying brightness or intensity of the light within the diaphragm 924. As one possibility, a greater amount of light may be expelled from the diaphragm 924 along a section of the perimeter 822 furthest away from the light source, whereas along a section of the perimeter 822 closest to the light source, a lesser amount may be expelled.

In one embodiment, as shown in FIG. 9A, the diaphragm 924 may include a series of light extraction features non-uniformly arranged on the translucent layer 940 (e.g., around the keycap 920 or in an area that controls illumination around the keycap 920). In particular, the diaphragm 924 may include at least a first light extraction feature 950*a* and a second light extraction feature 950*b*. The first and second light extraction features 950*a*, 950*b* may be configured to expel light from the translucent layer 940 into the gap 917. For example, the first light extraction feature 950*a* may be positioned below the gap 917 along a leftmost section of the perimeter 922 and cause light from within the translucent layer 940 to travel along a light path L6. Further, the second light extraction feature 950*b* may be positioned below the gap 917 and along a rightmost section of the perimeter 922 and cause light from within the translucent layer 940 to travel along a light path L7.

The first and second light extraction features 950*a*, 950*b* may be configured to expel an amount of light from the translucent layer 940 that accounts for a brightness or intensity of the light within the translucent layer 940. For example, the second light extraction feature 950*b* may be configured to expel a greater amount of light from the translucent layer 940 than the first light extraction feature 950*a*. The rightmost section of the perimeter 922 may be further away from the light source than the leftmost section of the perimeter 922, and thus the relatively greater amount of light expelled by the light extraction feature 950*b* may help contribute to the substantially uniform illumination of the entire perimeter 922 or halo around the keycap 920. Accordingly, notwithstanding the variable degree of brightness or intensity of light propagating within the translucent layer 940 along the light path L5 (due to a position of the light source), the illuminated halo or gap 917 may appear to a user to be substantially uniformly illuminated. Similar techniques may be used to produce other optical effects within the illuminated halo, including producing an illuminated halo having a specified color, brightness, and so on.

In another embodiment, as shown in FIG. 9B, the diaphragm 924 may include multiple opaque layers that operate to selectively allow light to pass through the translucent layer 940 and illuminate the gap 917. The opaque layers may be asymmetrically arranged along the translucent layer 940. The opaque layers each exhibit a distinct or variable opacity such that some (but not necessarily all) light is blocked from passing therethrough. The distinct opacities of the various opaque layers may therefore allow the diaphragm 924 to control the amount of light that is emitted, expelled, or otherwise passes through a thickness of the diaphragm 924 at a particular section of the gap 917.

In the embodiment of FIG. 9B, the diaphragm 924 may include at least a first light control layer 944*a* and a second light control layer 944*b*. The first and second light control layers 944*a*, 944*b* may be configured to allow a select amount of light from the translucent layer 942 to propagate into the gap 917. For example, the first light control layer 944*a* may be positioned below the gap 917 along a leftmost section of the perimeter 922 and allow light from within the translucent layer 940 to travel along a light path L6. Further, the second light control layer 944*b* may be positioned below the gap and along a rightmost section of the perimeter 922 and allow light from within the translucent layer 940 to travel along a light path L7.

The first and second light control layers 944*a*, 944*b* may be configured to allow passage of an amount of light from the translucent layer 940 that accounts for a brightness or intensity of the light within the translucent layer 940. For example, the second light control layer 944*b* may be configured to allow passage of a greater amount of light from the translucent layer 940 than the first light control layer 944*a*. The rightmost section of the perimeter 922 may be further away from the light source than the leftmost section of the perimeter 922, and thus the greater amount of light allowed passage at the second light control layer 944*b* may help contribute to the substantially uniform illumination of the entire perimeter 922 or halo around the keycap 920. Accordingly, notwithstanding the variable degree of brightness or intensity of light propagating within the translucent layer 940 along the light path L5 (due to a position of the light source), the illuminated halo or gap 917 may appear to a user to be substantially uniformly illuminated. Similar techniques may be used to produce other optical effects within the illuminated halo, including producing an illuminated halo having a specified color, brightness, and so on.

Other examples and implementations are within the scope and spirit of the disclosure and appended claims. For example, features implementing functions may also be physically located at various positions, including being distributed such that portions of functions are implemented at different physical locations. Also, as used herein, including in the claims, "or" as used in a list of items prefaced by "at least one of" indicates a disjunctive list such that, for example, a list of "at least one of A, B, or C" means A or B or C or AB or AC or BC or ABC (i.e., A and B and C). Further, the term "exemplary" does not mean that the described example is preferred or better than other examples.

The foregoing description, for purposes of explanation, uses specific nomenclature to provide a thorough understanding of the described embodiments. However, it will be apparent to one skilled in the art that the specific details are not required in order to practice the described embodiments. Thus, the foregoing descriptions of the specific embodiments described herein are presented for purposes of illustration and description. They are not targeted to be exhaustive or to limit the embodiments to the precise forms disclosed. It will be apparent to one of ordinary skill in the art that many modifications and variations are possible in view of the above teachings.

What is claimed is:

1. An electronic device comprising:

a key web defining an array of openings;

a keycap at least partially positioned within an opening of the array of openings and separated from the key web by a gap extending between a perimeter of the keycap and a surrounding portion of the key web;

a support structure coupled with an underside of the keycap;

a substrate positioned below the support structure;

a dome positioned on the substrate;

a diaphragm connected to the underside of the keycap and covering a portion of the substrate beneath the gap, the diaphragm comprising:

a translucent region configured to allow light to illuminate the keycap; and an opaque region configured to prevent light from illuminating the gap; and a light source positioned below the diaphragm.

2. The electronic device of claim 1, wherein:

a portion of the diaphragm connected to the underside of the keycap moves as the keycap is depressed;

the keycap includes an illuminable symbol;

the light source is configured to illuminate the illuminable symbol; and the diaphragm is configured to allow light from the light source to illuminate the illuminable symbol.

3. The electronic device of claim 1, wherein the diaphragm is configured to deform in response to downward movement of the keycap.

4. The electronic device of claim 1, wherein the diaphragm is further configured to impede light from the light source from passing through the gap, thereby causing a perimeter of the keycap to be unilluminated by the light source.

5. The electronic device of claim 1, wherein:

the diaphragm defines a barrier portion extending from the substrate to the underside of the keycap; and the barrier portion is configured to prevent ingress of contaminants.

6. An electronic device comprising:

a key web defining an array of openings;

a keycap at least partially positioned within an opening of the array of openings and separated from the key web by a gap extending between a perimeter of the keycap and a surrounding portion of the key web;

a support structure coupled with an underside of the keycap;

a substrate positioned below the support structure;

a diaphragm connected to the underside of the keycap and covering a portion of the substrate beneath the gap, the diaphragm defining a barrier portion extending from the substrate to the underside of the keycap, the barrier portion being configured to prevent ingress of contaminants; and a light source positioned below the diaphragm, the diaphragm being configured to control transmission of light through the gap;

wherein at least one surface of the barrier portion is configured to attract particulates.

7. An electronic device comprising:

a key web defining an array of openings;

a keycap at least partially positioned within an opening of the array of openings and separated from the key web by a gap extending between a perimeter of the keycap and a surrounding portion of the key web;

a support structure coupled with an underside of the keycap;

a substrate positioned below the support structure;

a diaphragm connected to the underside of the keycap and covering a portion of the substrate beneath the gap; and a light source positioned below the diaphragm, wherein the diaphragm is configured to control transmission of light through the gap;

wherein the diaphragm comprises a woven structure having interlocking fibers.

8. An input structure, comprising:

a keycap having an illuminable symbol;

a diaphragm positioned below the keycap and having an opaque layer positioned on a translucent layer, at least a portion of the diaphragm extending away from a perimeter of the keycap;

a support structure positioned below the keycap and configured to guide a downward movement of the keycap in response to a key press; and a light source positioned under the diaphragm and configured to illuminate the illuminable symbol, wherein:

the opaque layer is configured to impede light from the light source from illuminating a region around the perimeter of the keycap; and the diaphragm is configured to deform in response to the downward movement of the keycap;

the diaphragm defines a group of coupling passages;

the keycap comprises a group of engagement features, each engagement feature extending through a respective coupling passage of the group of coupling passages; and the each engagement feature is pivotally coupled with the support structure.

9. The input structure of claim 8, wherein:

the input structure further comprises a substrate positioned below the support structure;

the support structure is configured to move relative to the substrate in response to the key press; and the diaphragm forms a barrier portion extending along a curved path that extends from a peripheral portion of the keycap to the substrate.

10. The input structure of claim 9, wherein the diaphragm is configured to deform along the barrier portion as the keycap moves.

11. The input structure of claim 8, wherein:

the translucent layer defines:

a top surface that is coupled to the keycap; and a bottom surface opposite the top surface; and the opaque layer is positioned along one of the top surface or the bottom surface.

12. The input structure of claim 8, wherein:

a thickness of the translucent layer is less than or equal to 60 microns; and a thickness of the opaque layer is less than or equal to 10 microns.

13. The input structure of claim 8, wherein the opaque layer comprises an ink deposited on the translucent layer.

14. A keyboard, comprising:

a key web defining an opening;

a keycap positioned in the opening, the keycap including an engagement feature;

a dome configured to buckle in response to a depression of the keycap;

a support structure positioned about the dome and supporting the keycap;

a light source positioned below the keycap; and a diaphragm positioned above the light source, the diaphragm comprising:

a barrier portion extending outwardly from a peripheral portion of the keycap, the barrier portion configured to control illumination of a gap defined between the keycap and the opening in the key web; and a coupling passage;

wherein the engagement feature extends through the coupling passage to pivotally couple the keycap to the support structure.

15. The keyboard of claim 14, wherein:

the diaphragm comprises a translucent layer optically coupled with the light source; and the translucent layer is configured to redirect light from the light source towards the gap between the keycap and the opening in the key web.

16. A keyboard, comprising:

a key web defining an opening;

a keycap positioned in the opening;

a dome configured to buckle in response to a depression of the keycap;

a support structure positioned about the dome and supporting the keycap;

a light source positioned below the keycap; and a diaphragm positioned above the light source and having a barrier portion extending outwardly from a peripheral portion of the keycap, the barrier portion configured to control illumination of a gap defined between the keycap and the opening in the key web, the diaphragm comprising a translucent layer optically coupled with the light source, the translucent layer is configured to redirect light from the light source towards the gap between the keycap and the opening in the key web, wherein:

the translucent layer comprises light extraction features configured to extract light from the translucent layer and redirect the light from the light source towards the gap; and the light extraction features are non-uniformly arranged around the keycap to provide a substantially uniform distribution of light through the gap.

17. A keyboard, comprising:

a key web defining an opening;

a keycap positioned in the opening;

a dome configured to buckle in response to a depression of the keycap;

a support structure positioned about the dome and supporting the keycap;

a light source positioned below the keycap; and a diaphragm positioned above the light source and having a barrier portion extending outwardly from a peripheral portion of the keycap, the barrier portion configured to control illumination of a gap defined between the keycap and the opening in the key web, the diaphragm comprising a translucent layer optically coupled with the light source, the translucent layer is configured to redirect light from the light source towards the gap between the keycap and the opening in the key web, wherein:

the diaphragm further comprises a light control layer positioned along a top surface of the translucent layer; and the light control layer exhibits a variable opacity along the translucent layer to produce a substantially uniform distribution of light through the gap.

18. The keyboard of claim 17, wherein the light control layer is configured to substantially prevent illumination of the perimeter of the keycap by the light source.

* * * * *